US012264470B2

(12) United States Patent
Hsu

(10) Patent No.: US 12,264,470 B2
(45) Date of Patent: Apr. 1, 2025

(54) WATER SUPPLY SYSTEM OF TOILET TANK

(71) Applicant: HOKWANG INDUSTRIES CO., LTD., New Taipei (TW)

(72) Inventor: Chin-Chan Hsu, New Taipei (TW)

(73) Assignee: HOKWANG INDUSTRIES CO., LTD., New Taipei (TW)

( * ) Notice: Subject to any disclaimer, the term of this patent is extended or adjusted under 35 U.S.C. 154(b) by 251 days.

(21) Appl. No.: 18/091,546

(22) Filed: Dec. 30, 2022

(65) Prior Publication Data

US 2024/0218648 A1 Jul. 4, 2024

(51) Int. Cl.

| | |
|---|---|
| ***E03D 1/34*** | (2006.01) |
| ***E03D 1/32*** | (2006.01) |
| ***E03D 1/38*** | (2006.01) |
| ***E03D 5/02*** | (2006.01) |

(52) U.S. Cl.

CPC ..... *E03D 1/34* (2013.01); *E03D 1/32* (2013.01); *E03D 1/38* (2013.01); *E03D 5/02* (2013.01)

(58) Field of Classification Search

CPC .. E03D 5/02; E03D 5/12; E03D 5/022; E03D 5/024; E03D 5/10; E03D 1/32; E03D 1/38

USPC ..... 4/383, 389, 390

See application file for complete search history.

(56) References Cited

U.S. PATENT DOCUMENTS

| | | | | |
|---|---|---|---|---|
| 1,361,829 | A * | 12/1920 | Cody | E03C 1/01 4/594 |
| 2,091,170 | A * | 8/1937 | Tilden | E03C 1/232 4/679 |
| 2005/0278842 | A1* | 12/2005 | Yen | E03D 5/10 4/406 |
| 2009/0211009 | A1* | 8/2009 | Yen | E03D 5/024 4/407 |
| 2024/0218649 | A1* | 7/2024 | Hsu | E03D 5/026 |

FOREIGN PATENT DOCUMENTS

| | | | |
|---|---|---|---|
| CN | 202430798 U | | 9/2012 |
| CN | 206503204 U | * | 9/2017 |

* cited by examiner

*Primary Examiner* — Erin Deery

(74) *Attorney, Agent, or Firm* — Muncy, Geissler, Olds & Lowe, P.C.

(57) ABSTRACT

The invention provides a water supply system of a toilet tank, comprising a trigger switch, a water inlet pipe set and a drain pipe set. The inlet pipe set comprises a divergent water channel and a valve. The drain pipe set comprises a main drainpipe, an overflow manifold, a drain valve, and a drain valve actuator. The drain valve comprises a water stoppage valve cover and a rubber valve seat comprising a baffle which has a first state not affected by water entering the main drainpipe, and a second state affected by the water entering the main drainpipe. The main drainpipe communicates with the overflow manifold in the first state; and the junction between the main drainpipe and the overflow manifold is blocked by the baffle in the second state. The actuator drives the water stoppage valve cover when the channel is communicated.

12 Claims, 9 Drawing Sheets

WATER SUPPLY SYSTEM OF TOILET TANK

FIELD OF THE INVENTION

The invention relates to a water supply system, and more particularly to a water supply system capable of providing a fast water discharge function.

BACKGROUND OF THE INVENTION

In the existing toilet flushing technology, fast drainage has become an important technology, because if the toilet is operated and fails to discharge water quickly, it will lead to hygienic problems such as reduced air quality in the toilet or increased risk of users contacting with excrement. In addition, in some special environments, if the toilet itself does not have the function of quick water drainage, it will cause impact more serious than sanitary problems. For example, if the toilet installed in a prison does not have the function of quick water drainage, it may cause detainees to deliberately commit suicide with the water retained in the toilet; or if the toilet is installed in a mental hospital, in order to prevent the mentally ill patients from eating the excrement in the toilet by mistake, it is necessary to quickly drain the water after the mentally ill patients go to the toilet. For the above reasons, rapid water drainage has become an important function that a toilet must have.

In view of the above, in the existing toilet flushing technology, trigger switches and related modules are often installed on the toilet, and the object of rapid water discharge after the user goes to the toilet is achieved in an inductive manner. The relevant content can be found in CN 202430798U.

However, although CN 202430798U discloses three embodiments, all the embodiments disclosed use the solenoid valve as the main actuator to drive the flush valve, and use the solenoid valve to directly actuate the rotating shaft or the sliding rod. The power of the solenoid valve itself is depended on in resisting the water pressure endured by the flush valve in order to open the flush valve, which not only depends on the performance of the solenoid valve, but also has the concern of failure in the long run. As a result, it is uncertain that the flush valve can be quickly opened reliably and can achieve the object of rapid water discharge.

SUMMARY OF THE INVENTION

A main object of the invention is to solve the problem that the conventional toilet flushing technology is incapable of reliably providing a fast water discharge function.

In order to achieve the above object, the invention provides a water supply system of a toilet tank, comprising a trigger switch, a water inlet pipe set, and a drain pipe set. The trigger switch is disposed on one of following groups: a toilet tank, a toilet seat, a component independent of a toilet. The water inlet pipe set is disposed in the toilet tank, and the water inlet pipe set comprises a main water inlet channel communicating with an inner space of the toilet tank, a divergent water channel communicating with the main water inlet channel, and a valve connected with the trigger switch and controlled by the trigger switch to determine whether the divergent water channel is communicated or not. The drain pipe set is disposed in the toilet tank, and the drain pipe set comprises a main drainpipe, an overflow manifold communicating with the main drainpipe, a drain valve, and a drain valve actuator attached to the overflow manifold and connected to the divergent water channel. The drain valve comprises a rubber valve seat disposed on a port of the main drainpipe, and a water stoppage valve cover cooperating with the rubber valve seat and pivotally connected to the overflow manifold. The rubber valve seat comprises a baffle extending to a junction between the main drainpipe and the overflow manifold. The baffle has a first state in which the baffle is not affected by water entering the main drainpipe, and a second state in which the baffle affected by the water entering the main drainpipe, wherein in the first state, the main drainpipe communicates with the overflow manifold, and in the second state, the junction between the main drainpipe and the overflow manifold is blocked by the baffle, and wherein the drain valve actuator drives the water stoppage valve cover when the divergent water channel is communicated.

In one embodiment, the drain valve actuator comprises a driving rod connected to the water stoppage valve cover, a manual operating element facing the driving rod and provided for pushing the driving rod, and a pusher facing the driving rod and provided for pushing the driving rod, a direction of acting force provided by the manual operating element to the driving rod is different from that of the pusher, the pusher is connected to the divergent water channel, and wherein the pusher comprises a body, a water inlet communicating with the overflow manifold and an inside of the body, and a push-up element disposed in the body and pushed by a water flow.

In one embodiment, the pusher comprises a spring disposed in the body and connected to the push-up element.

In one embodiment, the body is formed with a plurality of water outlets with horizontal heights higher than that of the water inlet.

In one embodiment, the water inlet pipe set comprises a connecting pipe provided as a part of the divergent water channel and connected to the drain valve actuator.

In one embodiment, the water inlet pipe set comprises a plurality of pipe fittings connected in sequence, one of the plurality of pipe fittings is formed with a divergent opening provided as a part of the divergent water channel, and the valve comprises a solenoid valve attached inside one of the plurality of pipe fittings, and an inner conduit disposed in at least one of the plurality of pipe fittings and communicated to the divergent opening.

In one embodiment, the inner conduit comprises a hollow core pipe, and an outer ring connected to the hollow core pipe, and wherein the outer ring comprises a water opening facing the divergent opening, at least one connecting rib connected to the hollow core pipe, and a water passage disposed in the at least one connecting rib and communicating with the water opening and the hollow core pipe.

In one embodiment, one of the plurality of pipe fittings providing for the solenoid valve to be attached thereon comprising an outer pipe and an inner pipe, and wherein the inner pipe is disposed in the outer pipe and provides for the inner conduit to be disposed therein, the outer pipe is formed with a first opening facing the solenoid valve, the inner pipe is formed with a second opening facing the solenoid valve, and the second opening is located in the first opening.

In one embodiment, the baffle is replaced by a baffle ring formed integrally with the rubber valve seat.

In one embodiment, a side of the rubber valve seat facing the water stoppage valve cover is an inclined surface.

In one embodiment, the baffle comprises a first surface facing the junction between the main drainpipe and the overflow manifold, and a second surface on an opposite side of the first surface, the first surface is an inclined surface, and the second surface is a flat surface.

In one embodiment, the rubber valve seat comprises a seat opening, an edge of the seat opening is connected to the second surface, and there is no stepped portion between the edge of the seat opening and the second surface.

According to the aforementioned content of the invention, compared with the conventional technology, the invention has the following features: the invention controls the valve when the trigger switch is operated, and the valve only controls whether the divergent water channel communicates or does not communicate, rather than serving as a main actuator for driving the water stoppage valve cover, so that the invention does not need to rely too much on a power of the valve itself, and instead uses a power generated by a water flow to drive the drain valve actuator, thereby driving the water stoppage valve cover to achieve an object of fast water discharge, and to improve the problem that the conventional toilet flushing technology relies too much on a performance of the solenoid valve itself and may fail under long-term use to be incapable of reliably providing a fast water discharge function. In addition, in the second state of the invention, the baffle blocks the junction between the main drainpipe and the overflow manifold, thereby specifically reducing an air resistance of water in the toilet tank to discharge from the main drainpipe, which is conducive to improving water drainage efficiency.

DETAILED DESCRIPTION OF THE PREFERRED EMBODIMENTS

The detailed description and technical content of the invention are described below with reference to the accompanying drawings.

Hereinafter, the terms "first" and "second" used for components are intended to distinguish the components, and are not used to limit a sequence of the components.

Figure 1:
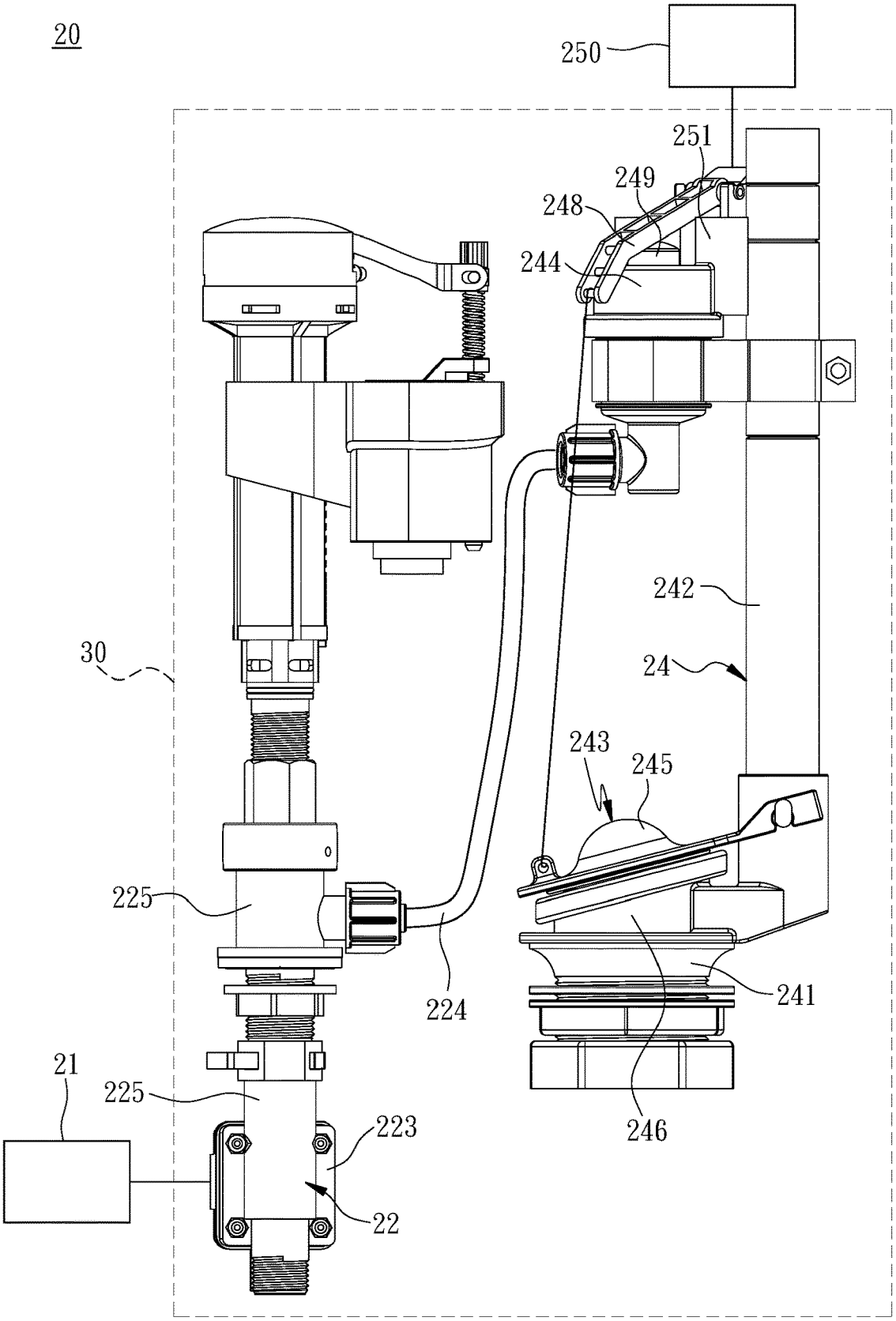
FIG. 1 is a schematic structural diagram of a water supply system according to an embodiment of the invention.
Figure 2:
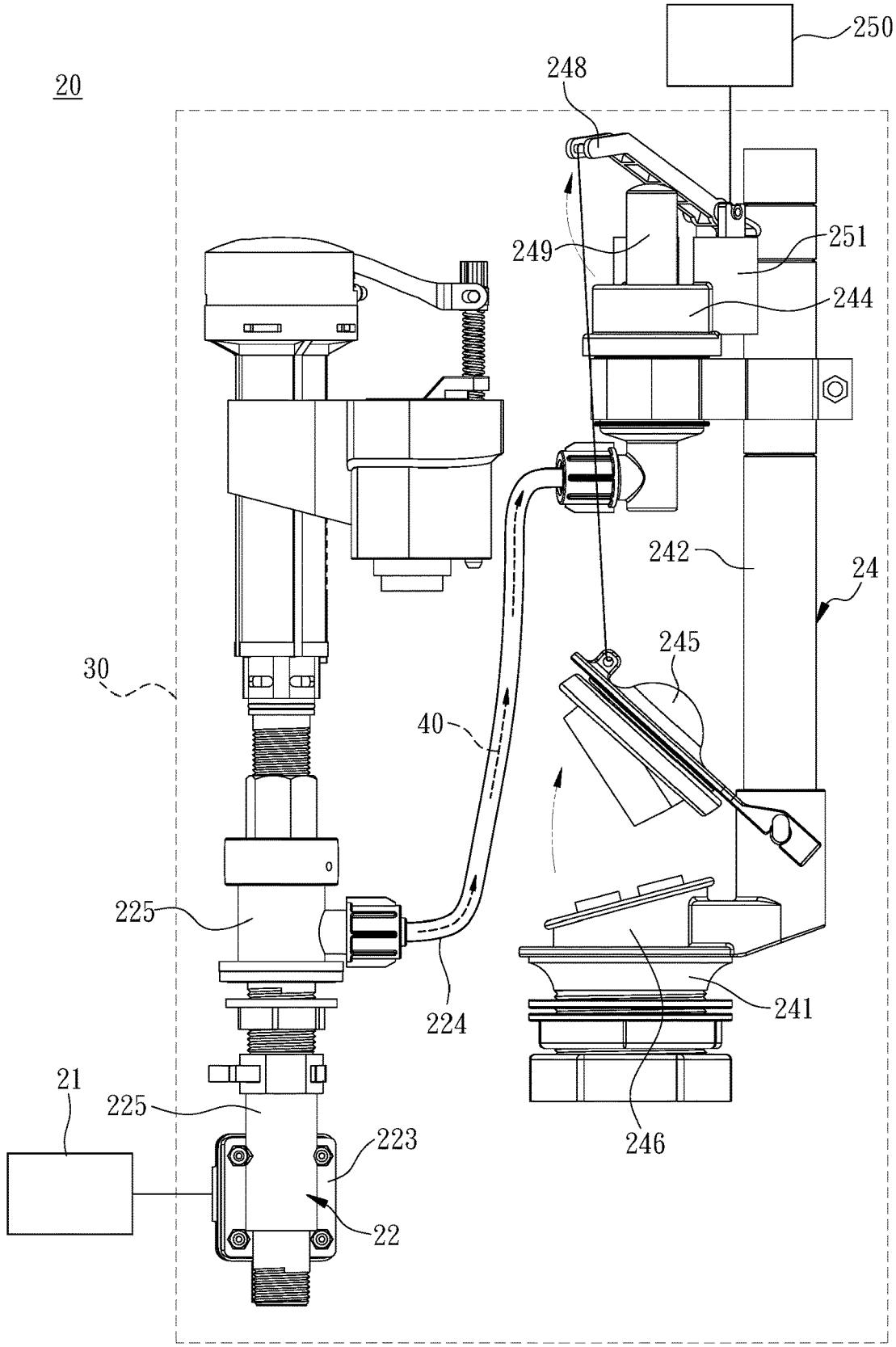
FIG. 2 is a schematic diagram of implementation of the water supply system according to an embodiment of the invention.
Figure 5:
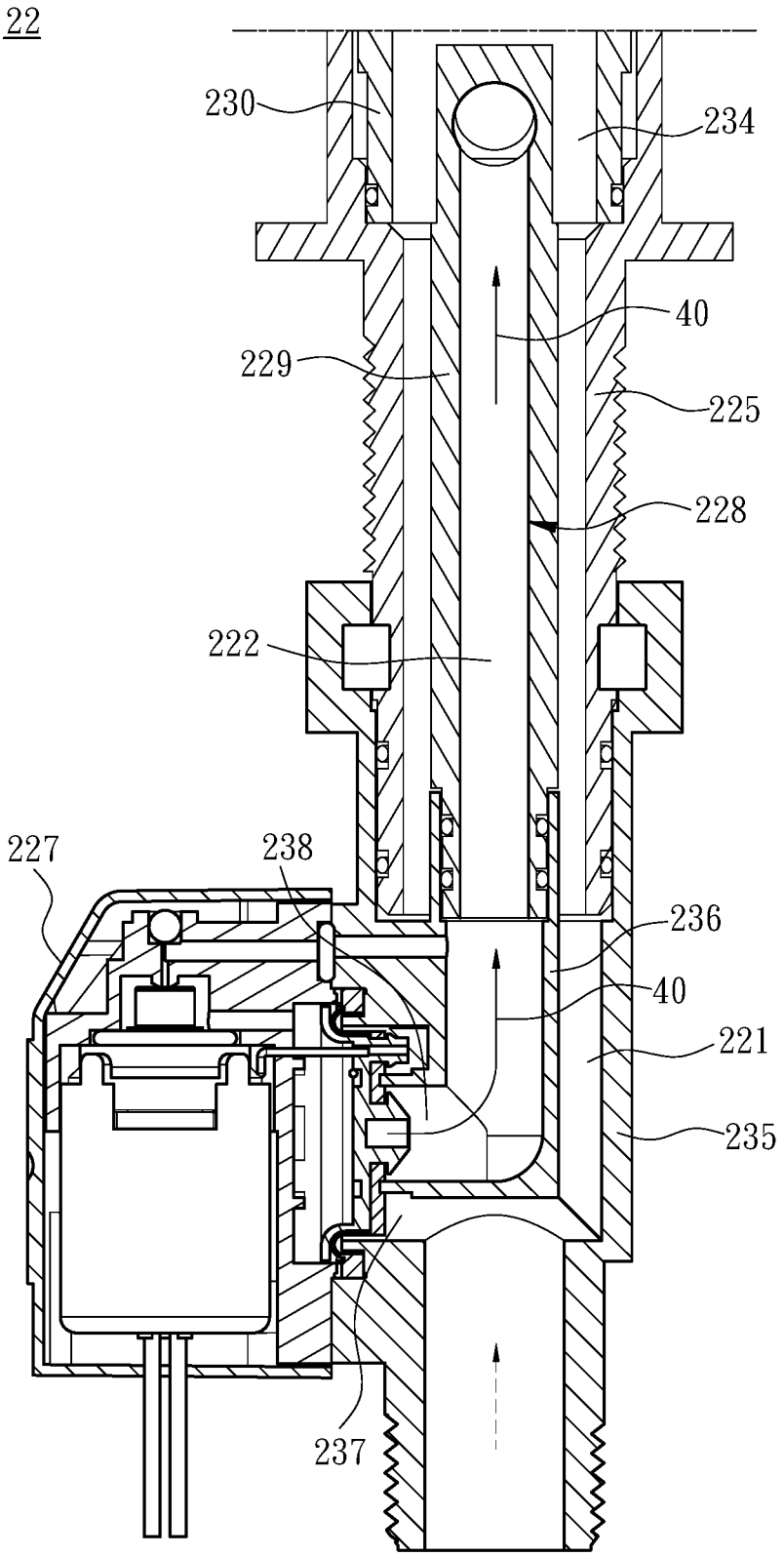
FIG. 5 is a first cross-sectional view of a structure of a water inlet pipe set according to an embodiment of the invention.
Figure 6:
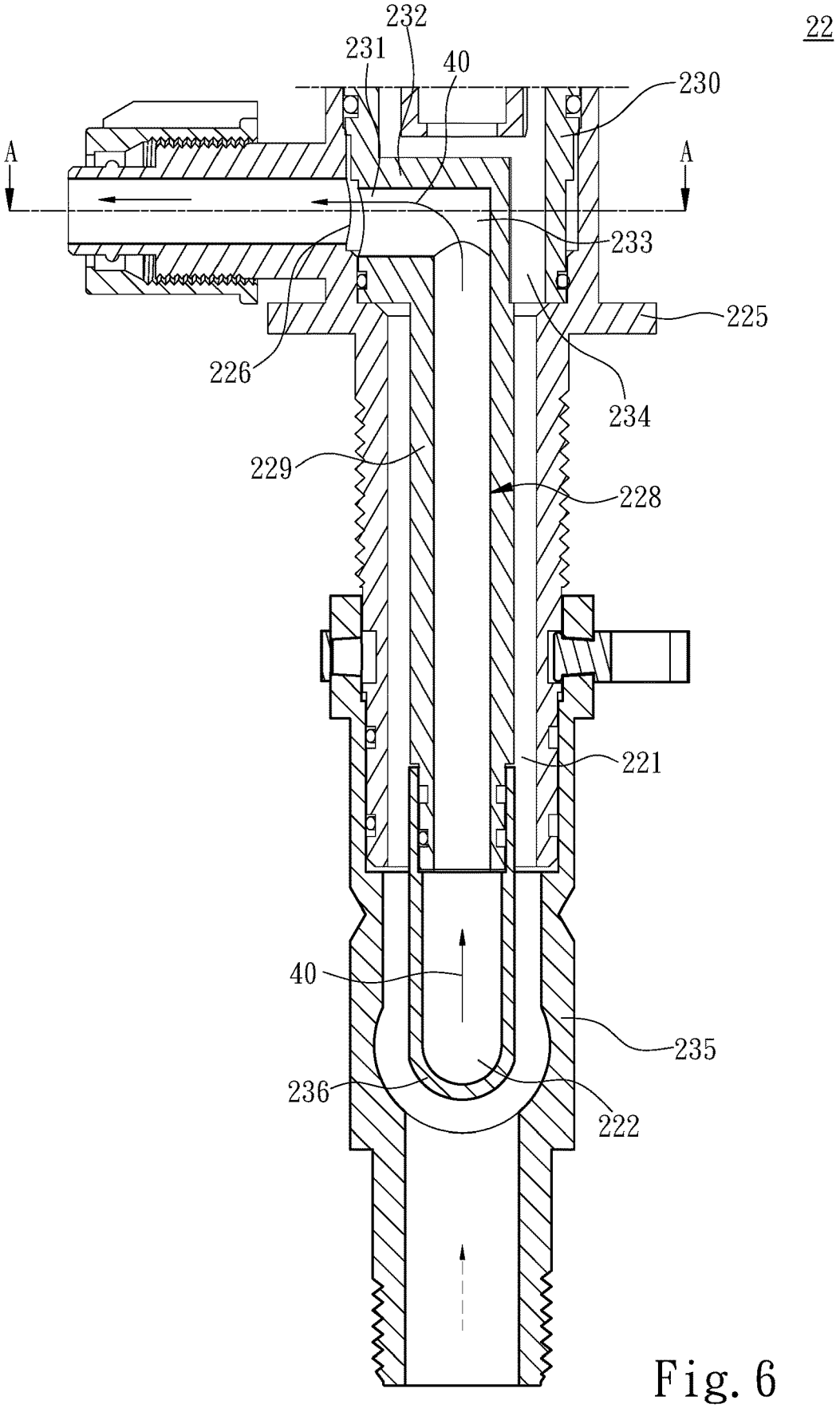
FIG. 6 is a second cross-sectional view of a structure of the water inlet pipe set according to an embodiment of the invention.

Please refer to FIG. 1, FIG. 5 and FIG. 6, the invention provides a water supply system 20 of a toilet tank. The water supply system 20 is applied to a toilet tank 30, and provides the toilet tank 30 with drainage function. The water supply system 20 comprises a trigger switch 21, a water inlet pipe set 22 and a drain pipe set 24. The trigger switch 21 is not limited to be disposed in the toilet tank 30, but can be disposed at any position according to requirements. For example, the trigger switch 21 can be directly disposed on a wall (not shown in the figures) adjacent to a toilet (not shown in the figures) to facilitate operation of the trigger switch 21 after going to toilet. The water inlet pipe set 22 is disposed in the toilet tank 30, and the water inlet pipe set 22 includes a main water inlet channel 221, a divergent water channel 222 and a valve 223. The main water inlet channel 221 communicates with an inner space of the toilet tank 30 and is provided for water flows into the toilet tank 30 from outside, so as to supply water to the toilet tank 30. The divergent water channel 222 communicates with the main water inlet channel 221. It should be noted that the divergent water channel 222 will not affect circulation of water in the main water inlet channel 221 and water supply of the main water inlet channel 221 to the toilet tank 30. The valve 223 is connected to the trigger switch 21, and the valve 223 is controlled by the trigger switch 21 to determine whether the divergent water channel 222 is communicated or not. In one embodiment, the water inlet pipe set 22 includes a connecting pipe 224, and the connecting pipe 224 serves as a part of the divergent water channel 222 and is connected to the drain pipe set 24, so as to form communication between the divergent water channel 222 and the drain pipe set 24. In an embodiment, the connecting pipe 224 is a hose.

The drain pipe set 24 is disposed in the toilet tank 30, and the drain pipe set 24 includes a main drainpipe 241, an overflow manifold 242, a drain valve 243 and a drain valve actuator 244. Please refer to FIG. 1, FIG. 8 and FIG. 9, the main drainpipe 241 communicates with outside of the toilet tank 30 and provides water drainage function, and the overflow manifold 242 communicates with the main drainpipe 241. The drain valve 243 comprises a water stoppage valve cover 245 and a rubber valve seat 246. The water stoppage valve cover 245 is pivotally connected to the overflow manifold 242, the water stoppage valve cover 245 cooperates with the rubber valve seat 246 and is capable of opening and closing relative to the rubber valve seat 246, and the rubber valve seat 246 is disposed on a port of the main drainpipe 241. In one embodiment, a side of the rubber valve seat 246 facing the water stoppage valve cover 245 is an inclined surface, so that the water stoppage valve cover 245 is inclined after being closed with the rubber valve seat 246. In addition, the rubber valve seat 246 is made of rubber material and is different from the conventional hard material. The rubber valve seat 246 includes a baffle 247, and the baffle 247 extends to a junction between the main drainpipe 241 and the overflow manifold 242, and the baffle 247 is located close to an inner wall of the main drainpipe 241. On the other hand, the drain valve actuator 244 is attached to the overflow manifold 242 and connected to the divergent water channel 222. A function of the drain valve actuator 244 is to receive water from the divergent water channel 222 and drive the water stoppage valve cover 245.

Please refer to FIG. 1, FIG. 2, FIG. 3, FIG. 4, FIG. 5, and FIG. 6, operation of the water supply system 20 will be described below. Assuming that initially, the water supply system 20 is as shown in FIG. 1, the trigger switch 21 has not been operated, and the valve 223 makes the divergent water channel 222 to be non-communicated. At the same time, the drain valve actuator 244 is not activated, the water stoppage valve cover 245 is not opened relative to the rubber valve seat 246, and the water stoppage valve cover 245 blocks communication between the main drainpipe 241 and the inner space of the toilet tank 30. Please refer to FIG. 2, when the trigger switch 21 is operated, the trigger switch 21 controls the valve 223 and makes the divergent water channel 222 being communicated. At this time, the divergent water channel 222 is provided for external water to flow therein to form a water flow 40, and the water flow 40 passes through the divergent water channel 222 and flows to the drain valve actuator 244. The drain valve actuator 244 receives the water flow 40 and is pushed by the water flow 40. During a process of the water flow 40 pushing the drain valve actuator 244, the water stoppage valve cover 245 is driven. At the same time, the water stoppage valve cover 245 is opened relative to the rubber valve seat 246, and enables an inner space of the main drainpipe 241 to communicate with the inner space of the toilet tank 30, so that water in the toilet tank 30 is capable of flowing into the main drainpipe 241 and discharging to outside of the toilet tank 30.

The following is an example of practical application of the invention. The water supply system 20 can be practically applied to a sitting toilet (not shown in the figures). During implementation, the trigger switch 21 is disposed in a toilet seat (not shown in the figures), and the water inlet pipe set 22 and the drain pipe set 24 are disposed in a water tank (not shown in the figures) of the sitting toilet, when a user (not shown in the figures) sits on the toilet seat and is finished with going to toilet and gets up and leaves the toilet seat, the trigger switch 21 senses the user is leaving and generates a control signal (not shown in the figures). The valve 223 receives the control signal and changes its state based on the control signal to make the divergent water channel 222 being communicated and enable water to flow into the divergent water channel 222, thereby the water flow 40 is capable of pushing the drain valve actuator 244 and driving the water stoppage valve cover 245 to achieve an efficacy of rapid water drainage.

From the above, it can be known that the valve 223 of the invention only controls whether the divergent water channel 222 communicates or does not communicate, rather than serving as a main actuator for driving the water stoppage valve cover 245, so that the invention does not need to rely too much on a power of the valve 223 itself, and instead uses a power generated by the water flow 40 to drive the drain valve actuator 244, thereby driving the water stoppage valve cover 245 to achieve an object of fast water discharge, and to improve the problem that the conventional toilet flushing technology relies too much on a performance of the solenoid valve itself and may fail under long-term use to be incapable of reliably providing a fast water discharge function.

Further, the baffle 247 has a first state in which the baffle 247 is not affected by water entering the main drainpipe 241, and the main drainpipe 241 communicates with the overflow manifold 242 under the first state; and a second state in which the baffle 247 is affected by water entering the main drainpipe 241, and the junction between the main drainpipe 241 and the overflow manifold 242 is blocked by the baffle 247 under the second state.

Figure 9:
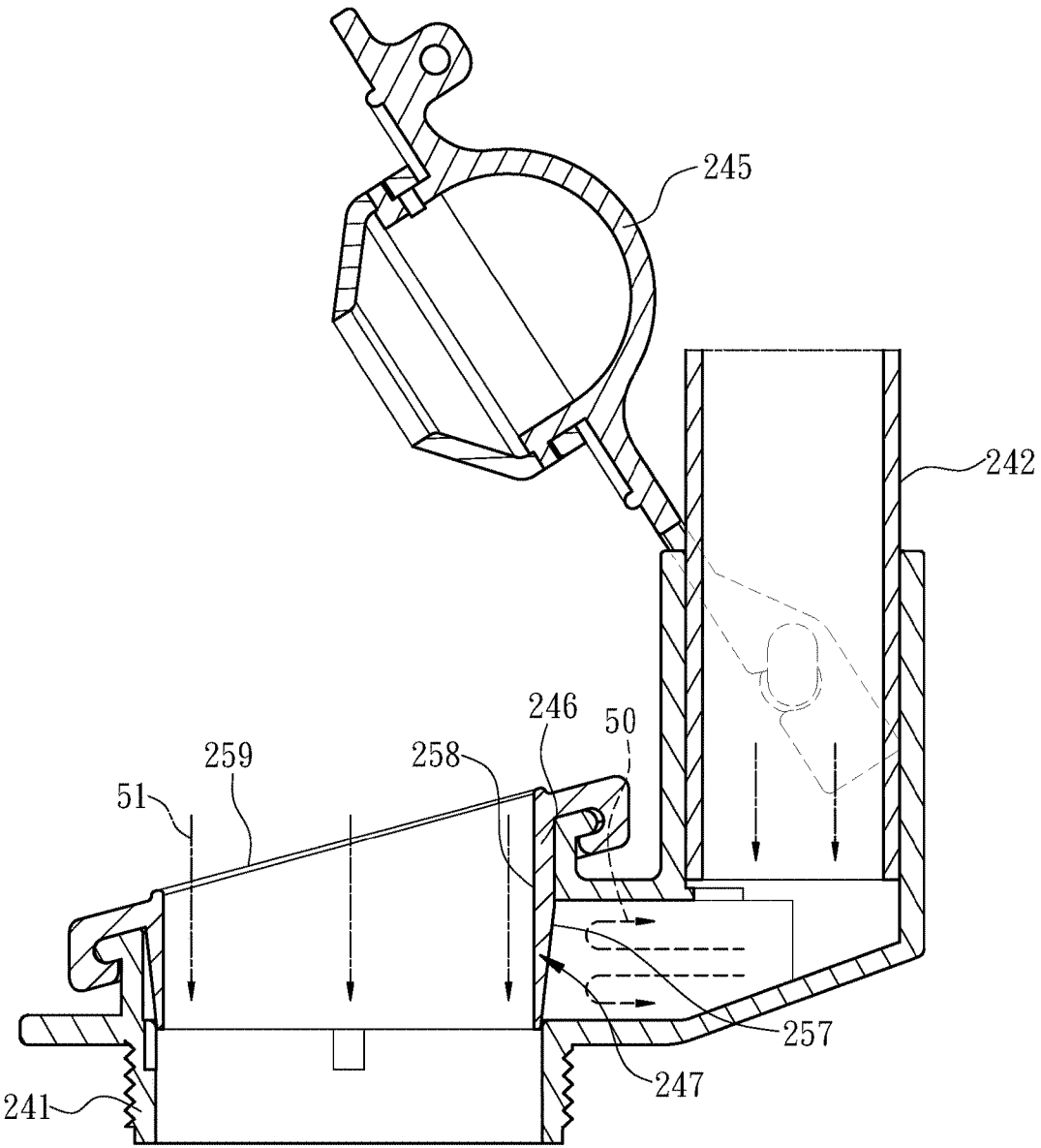
FIG. 9 is a schematic diagram of implementation of the drain valve according to an embodiment of the invention.

In detail, when water does not flow into the main drainpipe 241 from the toilet tank 30, the baffle 247 is in the first state, and the baffle 247 does not completely close the junction between the main drainpipe 241 and the overflow manifold 242, so that there is a gap at the junction to enable the water flowing into the overflow manifold 242 to flow out of the main drainpipe 241 through the junction between the main drainpipe 241 and the overflow manifold 242. On the other hand, when the water (as labeled by the reference numeral "51") flows into the main drainpipe 241 from the toilet tank 30, the baffle 247 will be in the second state under influence of the water (as labeled by the reference numeral "51"). The baffle 247 resists an air resistance from the junction between the main drainpipe 241 and the overflow manifold 242, and enables the water (as labeled by the reference numeral "51") to be capable of flowing into the main drainpipe 241 smoothly. The reference numeral "50" in FIG. 9 represents an air resistance blocked by the baffle 247. The invention specifically reduces an air resistance when water in the toilet tank 30 is discharged from the main drainpipe 241 through the baffle 247, and improves a drainage efficiency. In one embodiment, the baffle 247 can also be replaced by a baffle ring integrally formed with the rubber valve seat 246.

Figure 3:
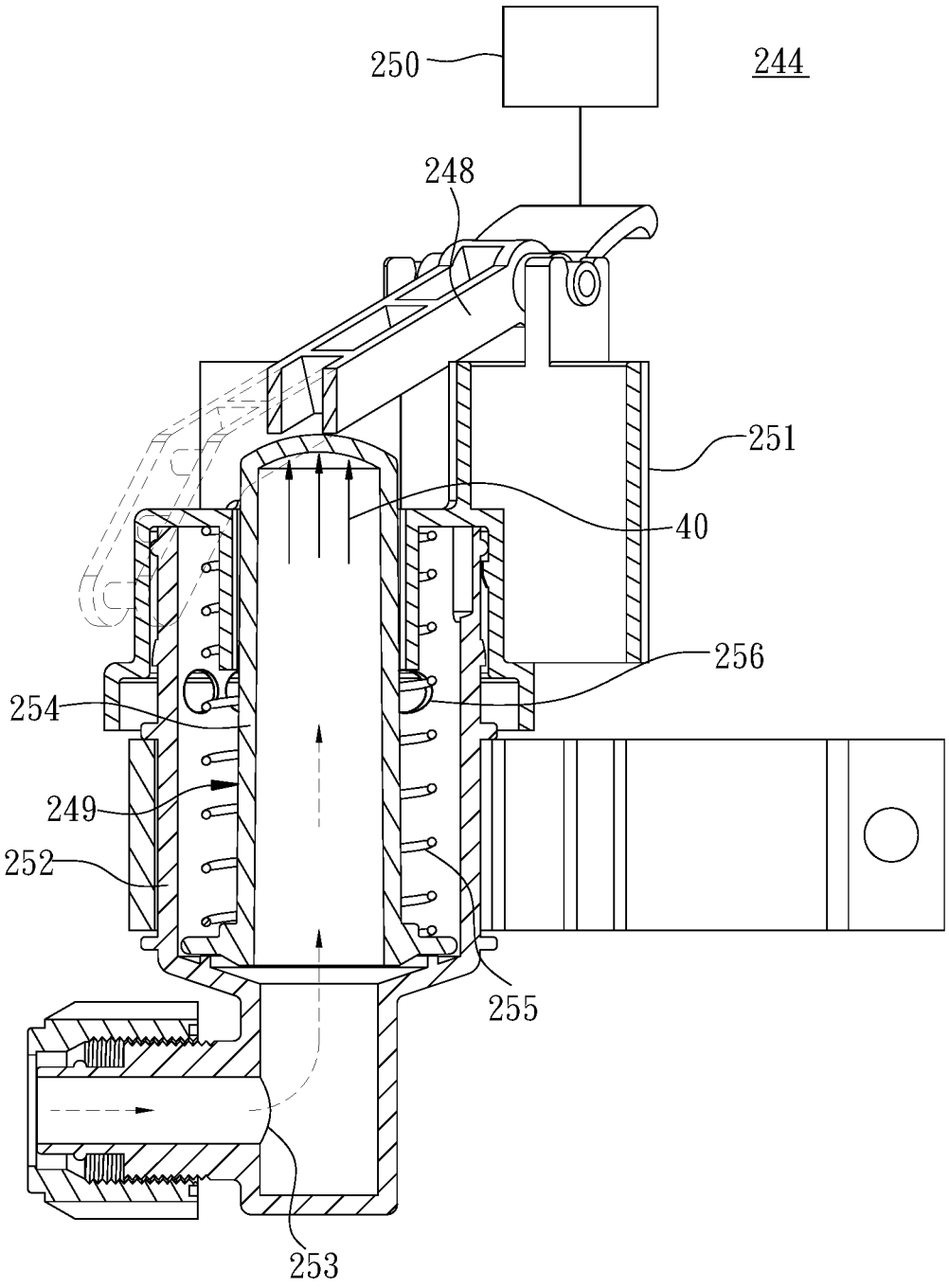
FIG. 3 is a cross-sectional view of a structure of a drain valve actuator according to an embodiment of the invention.
Figure 4:
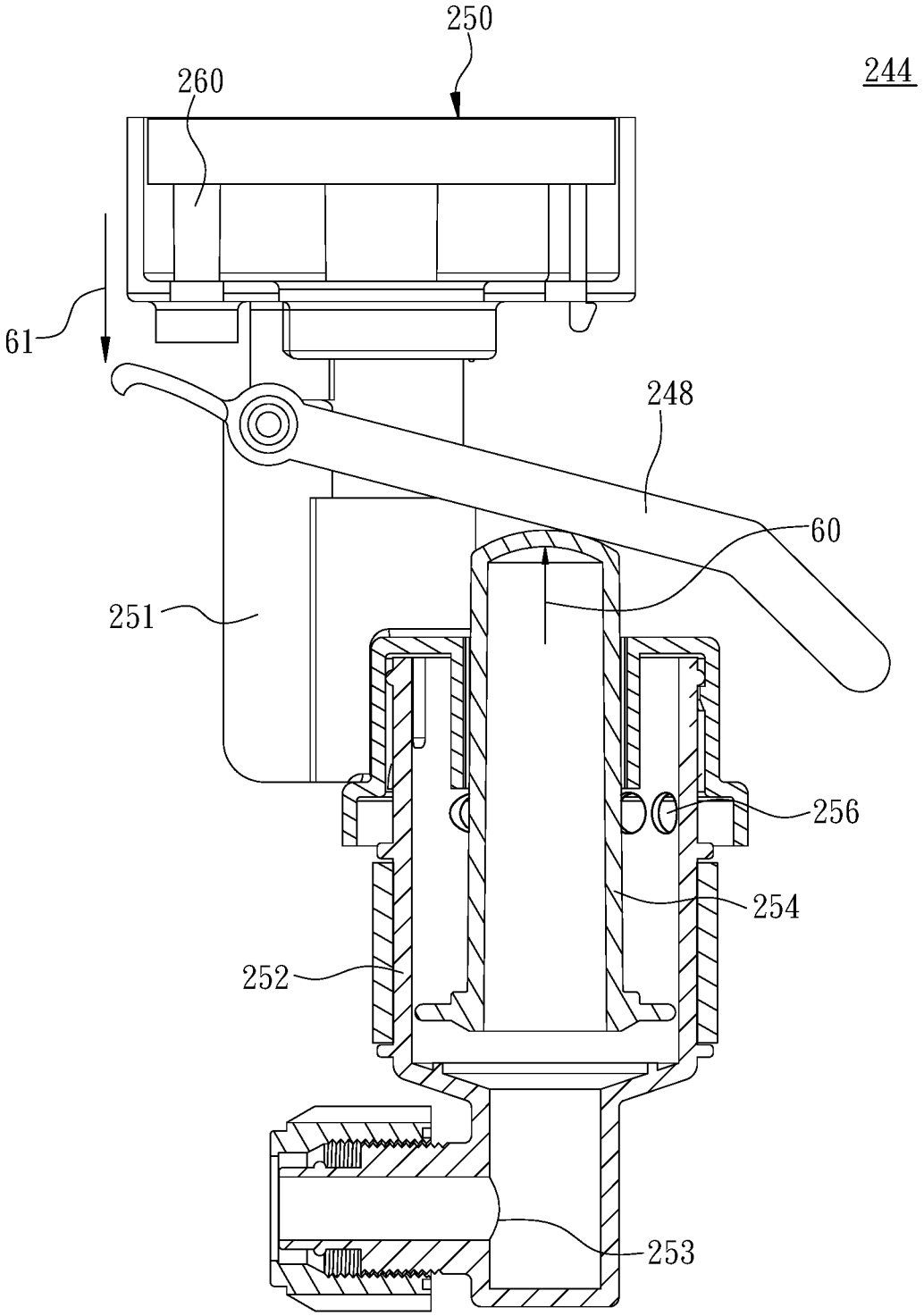
FIG. 4 is a cross-sectional view of a structure of the drain valve actuator according to another embodiment of the invention.
Figure 8:
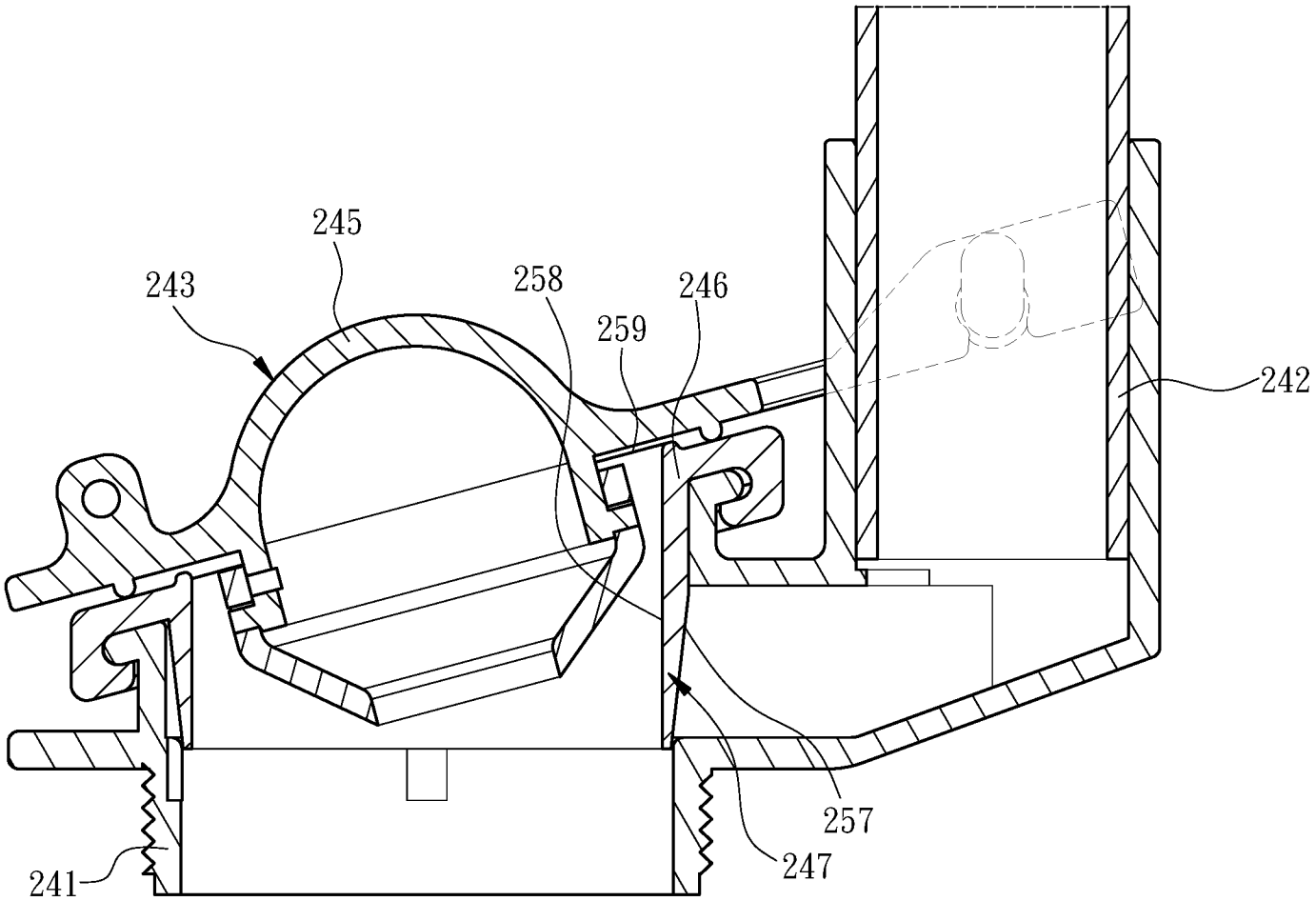
FIG. 8 is a structural schematic diagram of a drain valve according to an embodiment of the invention.

Please refer to FIG. 3, FIG. 4 and FIG. 8, the drain valve actuator 244 of the invention comprises a driving rod 248, a pusher 249, and a manual operating element 250. The driving rod 248 is connected to the water stoppage valve cover 245 and forms a linkage relationship with the water stoppage valve cover 245, the pusher 249 faces the driving rod 248 and is capable of pushing the driving rod 248, and the manual operating element 250 faces the driving rod 248 and is capable of pushing the driving rod 248. A direction of acting force provided by the manual operating element 250 to the driving rod 248 is different from that of the pusher 249. In detail, the drain valve actuator 244 comprises at least two connecting columns 251, the driving rod 248 is connected to the water stoppage valve cover 245 and pivotally connected on the two connecting columns 251, the pusher 249 and the manual operating element 250 are respectively disposed on two opposite sides of a position where the driving rod 248 is pivotally connected to the two connecting columns 251, and therefore a direction of acting force of the pusher 249 pushing the driving rod 248 will be different from a direction in which the manual operating element 250 pushes the driving rod 248. In FIG. 4, the reference numeral "60" represents a direction of acting force of the pusher 249 pushing the driving rod 248, and the reference numeral "61" represents a direction of acting force of the manual operating element 250 pushing the driving rod 248. In addition, it should be understood that application of the water supply system 20 of the invention is not limited to using either the pusher 249 or the manual operating element 250 as a main operating component for pushing the driving rod 248. In addition, the manual operating element 250 of the invention can be a driving lever attached to the toilet tank 30, or a pressing structure disposed on the toilet tank 30. In one embodiment, the manual operating element 250 includes at least two buttons 260, the two buttons 260 are used to push the manual operating element 250 and then push the driving rod 248, and provide a flushing function with different water volumes for the water supply system 20.

The pusher 249 comprises a body 252, a water inlet 253, and a push-up element 254. The water inlet 253 communicates with the overflow manifold 242 and an inside of the body 252, and enables the water flow 40 from the overflow manifold 242 to pass through and flow into the body 252, the push-up element 254 is disposed in the body 252, the push-up element 254 receives the water flow 40 flowing into the body 252 and is pushed by the water flow 40 to push the driving rod 248. It should be noted that in the invention, after the push-up element 254 pushes the driving rod 248 and stops receiving the water flow 40, the driving rod 248 will be driven by the water stoppage valve cover 245 based on a linkage relationship between the driving rod 248 and the water stoppage valve cover 245, and when the water stoppage valve cover 245 is closed relative to the rubber valve seat 246, the driving rod 248 is driven to push the push-up element 254 to its original position, thereby completing a reset action of the push-up element 254. In one embodiment, in order to improve a reset efficiency of the push-up element 254, the pusher 249 includes a spring 255 disposed in the body 252 and connected to the push-up element 254. In addition, in one embodiment, the body 252 is formed with a plurality of water outlets 256, wherein horizontal heights of the plurality of water outlets 256 are higher than that of the water inlet 253, and the plurality of water outlets 256 enable water in the body 252 to flow out of the body 252.

Figure 7:
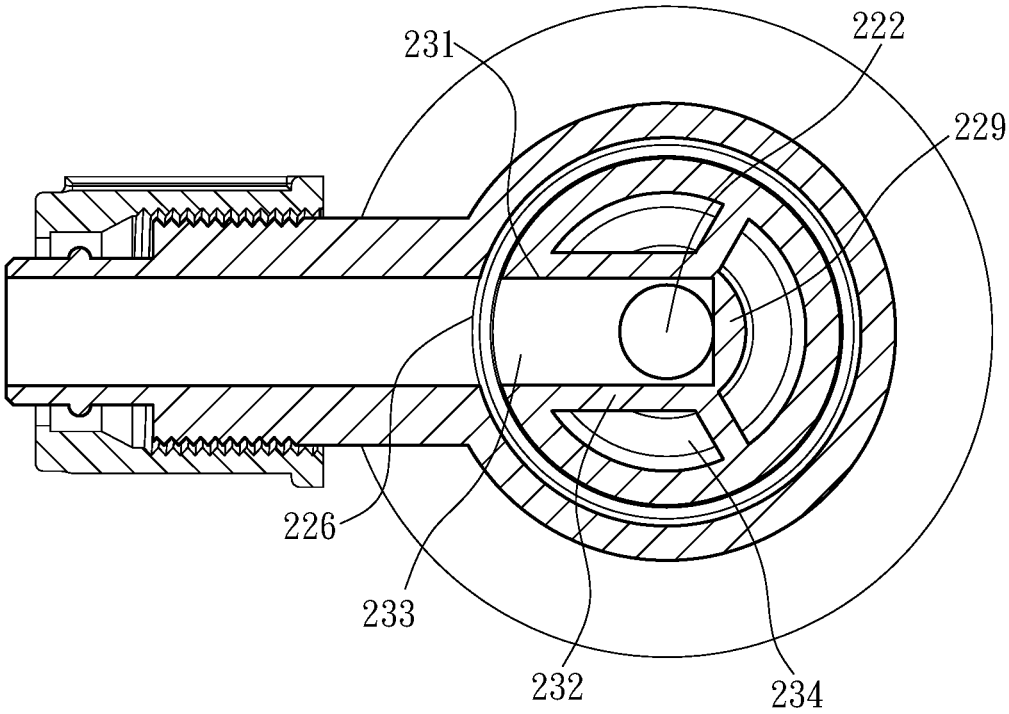
FIG. 7 is a cross-sectional view of a structure of the water inlet pipe set along section line A-A in FIG. 6 according to an embodiment of the invention.

Please refer to FIG. 5, FIG. 6, FIG. 7, the water inlet pipe set 22 of the invention comprises a plurality of pipe fittings 225, and one of the pipe fittings 225 is formed with a divergent opening 226, and the divergent opening 226 serves as a part of the divergent water channel 222. On the other hand, the valve 223 comprises a solenoid valve 227 and an inner conduit 228. The solenoid valve 227 is attached to one of the pipe fittings 225, and the inner conduit 228 is disposed in at least one of the plurality of pipe fittings 225 and communicates with the divergent opening 226. Further, the inner conduit 228 includes a hollow core pipe 229 and an outer ring 230, wherein an inner space of the hollow core pipe 229 serves as a part of the divergent water channel 222, and the outer ring 230 communicates with the hollow core pipe 229. The outer ring 230 comprises a water opening 231, at least one connecting rib 232 and a water passage 233. The water opening 231 communicates with the at least one connecting rib 232 and faces the divergent opening 226, and the water opening 231 serves as a part of the divergent water channel 222. The at least one connecting rib 232 is connected to the hollow core pipe 229, the at least one connecting rib 232 and an inner wall of the outer ring 230 jointly form at least one water inlet passage 234, and the water inlet passage 234 serves as a part of the main water inlet channel 221. In addition, the water passage 233 is disposed on one of the at least one connecting rib 232 facing the divergent opening 226, and communicates with the water opening 231 and the hollow core pipe 229. The water passage 233 serves as a part of the divergent water channel 222. Further, one of the plurality of pipe fittings 225 that provides for the solenoid valve 227 to be attached includes an outer pipe 235 and an inner pipe 236. The outer pipe 235 is formed with a first opening 237 facing the solenoid valve 227. The inner pipe 236 is in the outer pipe 235 and communicates with the inner conduit 228, and an inner space of the inner pipe 236 serves as a part of the divergent water channel 222. The inner pipe 236 is formed with a second opening 238 facing the solenoid valve 227, and the second opening 238 is located in the first opening 237.

It can be known from the above that, in one embodiment, the divergent water channel 222 of the invention is formed by the inner space of the inner pipe 236, the inner space of the hollow core pipe 229, and an inner space of one of the at least one connecting rib 232 formed with the water passage 233, and communicates with the second opening 238, the water passage 233, the water opening 231, the divergent opening 226, and the connecting pipe 224 in sequence. The main water inlet channel 221 is formed sequentially by an interval between an outer wall of the inner pipe 236 and the outer pipe 235, an interval between an outer wall of the hollow core pipe 229 and at least one of the pipe fittings 225 that provides disposition for the inner conduit 228, and the water inlet passage 234.

Please refer to FIG. 8 and FIG. 9, the baffle 247 of the invention has a first surface 257 and a second surface 258. The first surface 257 is an inclined surface and faces the junction between the main drainpipe 241 and the overflow manifold 242. The second surface 258 is a flat surface and is located on an opposite side of the first surface 257, and the second surface 258 receives water (as labeled by the reference numeral "51") flowing from the toilet tank 30 into the main drainpipe 241. Further, the rubber valve seat 246 comprises a seat opening 259, and an edge of the seat opening 259 is connected to the second surface 258. In one embodiment, in order to improve a smoothness of flowing of water (as labeled by the reference numeral "51"), there is no stepped portion between the edge of seat opening 259 and the second surface 258.

What is claimed is:

1. A water supply system of a toilet tank, comprising:

a trigger switch, disposed on one of following groups: a toilet tank, a toilet seat, a component independent of a toilet;

a water inlet pipe set, disposed in the toilet tank, and the water inlet pipe set comprising a main water inlet channel communicating with an inner space of the toilet tank, a divergent water channel communicating with the main water inlet channel, and a valve connected with the trigger switch and controlled by the trigger switch to determine whether the divergent water channel is communicated or not; and a drain pipe set, disposed in the toilet tank, and the drain pipe set comprising a main drainpipe, an overflow manifold communicating with the main drainpipe, a drain valve, and a drain valve actuator attached to the overflow manifold and connected to the divergent water channel, the drain valve comprising a rubber valve seat disposed on a port of the main drainpipe, and a water stoppage valve cover cooperating with the rubber valve seat and pivotally connected to the overflow manifold, the rubber valve seat comprising a baffle extending to a junction between the main drainpipe and the overflow manifold, the baffle having a first state in which the baffle is not affected by water entering the main drainpipe, and a second state in which the baffle affected by the water entering the main drainpipe, wherein in the first state, the main drainpipe communicates with the overflow manifold, and in the second state, the junction between the main drainpipe and the overflow manifold is blocked by the baffle, and wherein the drain valve actuator drives the water stoppage valve cover when the divergent water channel is communicated.

2. The water supply system of the toilet tank as claimed in claim 1, wherein the drain valve actuator comprises a driving rod connected to the water stoppage valve cover, a manual operating element facing the driving rod and provided for pushing the driving rod, and a pusher facing the driving rod and provided for pushing the driving rod, a direction of acting force provided by the manual operating element to the driving rod is different from that of the pusher, the pusher is connected to the divergent water channel, and wherein the pusher comprises a body, a water inlet communicating with an inside of the body, and a push-up element disposed in the body and pushed by a water flow.

3. The water supply system of the toilet tank as claimed in claim 2, wherein the pusher comprises a spring disposed in the body and connected to the push-up element.

4. The water supply system of the toilet tank as claimed in claim 3, wherein the body is formed with a plurality of water outlets with horizontal heights higher than that of the water inlet.

5. The water supply system of the toilet tank as claimed in claim 4, wherein the water inlet pipe set comprises a connecting pipe provided as a part of the divergent water channel and connected to the drain valve actuator.

6. The water supply system of the toilet tank as claimed in claim 1, wherein the water inlet pipe set comprises a plurality of pipe fittings connected in sequence, one of the plurality of pipe fittings is formed with a divergent opening provided as a part of the divergent water channel, and the valve comprises a solenoid valve attached inside one of the plurality of pipe fittings, and an inner conduit disposed in at least one of the plurality of pipe fittings and communicated to the divergent opening.

7. The water supply system of the toilet tank as claimed in claim 6, wherein the inner conduit comprises a hollow core pipe, and an outer ring connected to the hollow core pipe, and wherein the outer ring comprises a water opening facing the divergent opening, at least one connecting rib connected to the hollow core pipe, and a water passage disposed in the at least one connecting rib and communicating with the water opening and the hollow core pipe.

8. The water supply system of the toilet tank as claimed in claim 7, wherein one of the plurality of pipe fittings which provides for the solenoid valve to be attached thereon comprises an outer pipe and an inner pipe, and wherein the inner pipe is disposed in the outer pipe and provides for the inner conduit to be disposed therein, the outer pipe is formed with a first opening facing the solenoid valve, the inner pipe is formed with a second opening facing the solenoid valve, and the second opening is located in the first opening.

9. The water supply system of the toilet tank as claimed in claim 1, wherein the baffle is a baffle ring which is integrally formed with the rubber valve seat.

10. The water supply system of the toilet tank as claimed in claim 1, wherein a side of the rubber valve seat facing the water stoppage valve cover is an inclined surface.

11. The water supply system of the toilet tank as claimed in claim 1, wherein the baffle comprises a first surface facing the junction between the main drainpipe and the overflow manifold, and a second surface on an opposite side of the first surface, the first surface is an inclined surface, and the second surface is a flat surface.

12. The water supply system of the toilet tank as claimed in claim 11, wherein the rubber valve seat comprises a seat opening, an edge of the seat opening is connected to the second surface, and there is no stepped portion between the edge of the seat opening and the second surface.

* * * * *